US005347738A

United States Patent [19]

Zweig et al.

[11] Patent Number: 5,347,738

[45] Date of Patent: Sep. 20, 1994

[54] DISPLAY DEVICE FOR PHOTOGRAPHS AND PRINTED IMAGES

[75] Inventors: Jan B. Zweig, Playa del Rey; Miller Y. Fong, Pasadena, both of Calif.

[73] Assignee: Jan and Miller, Inc., Venice, Calif.

[21] Appl. No.: 970,797

[22] Filed: Nov. 3, 1992

[51] Int. Cl.[5] ..... G09F 3/18

[52] U.S. Cl. ..... 40/642; 206/45.2

[58] Field of Search ..... 40/642, 661, 358; 211/11, 184; 248/473; 206/459.5, 45.2, 454

[56] References Cited

U.S. PATENT DOCUMENTS

| | | | |
|---|---|---|---|
| 1,857,552 | 5/1932 | Komorous | 40/642 |
| 4,588,086 | 5/1986 | Coe | 206/454 |
| 4,685,647 | 8/1987 | Colhoun | 248/473 |

FOREIGN PATENT DOCUMENTS

| | | | |
|---|---|---|---|
| 696912 | 10/1974 | Canada | 206/45.2 |
| 631263 | 12/1927 | France | 248/473 |
| 1043015 | 6/1953 | France | 206/45.2 |

*Primary Examiner*—Kenneth J. Dorner
*Assistant Examiner*—J. Silbermann
*Attorney, Agent, or Firm*—Graham & James

[57] ABSTRACT

A device for storing and displaying one or more photographs is disclosed. The device includes at least one display plate for holding one of the photographs, and a container having a top that includes one or more display slots for holding a display plate. A photograph is mounted in the display plate and the display plate is then attached to one of the display slots to display the photograph. Additional photographs may be stored inside the container when they are not being displayed.

3 Claims, 2 Drawing Sheets

FIG. 3
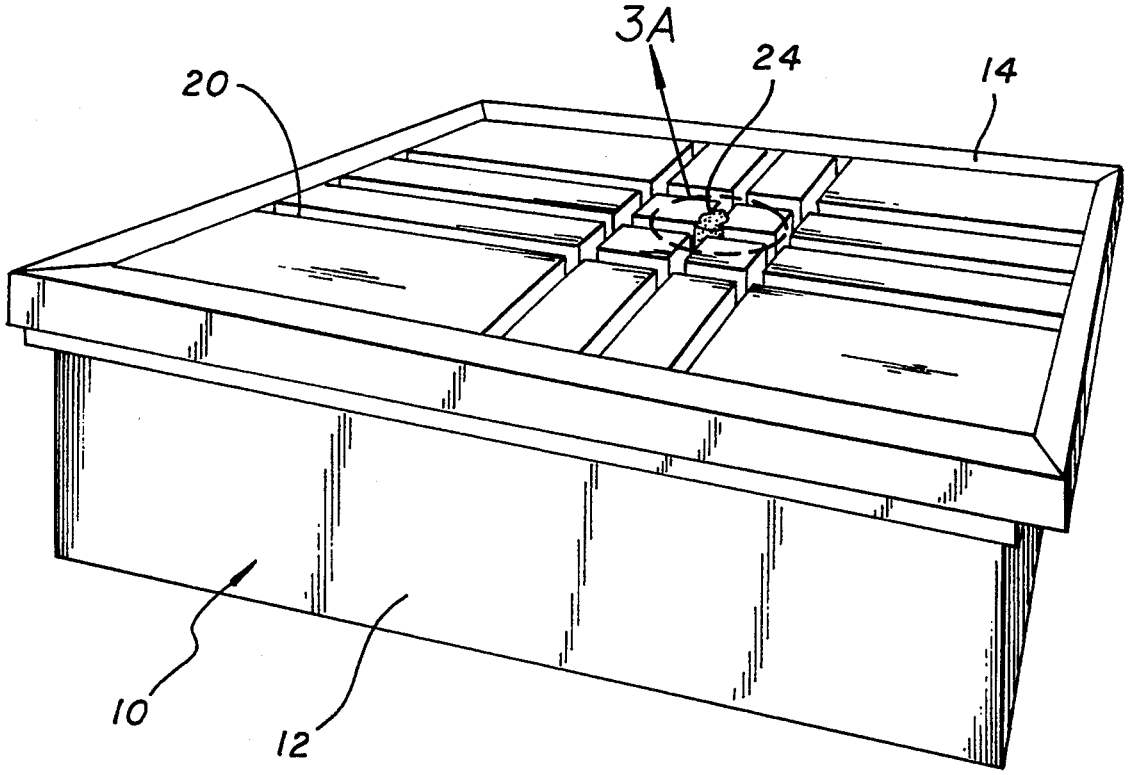
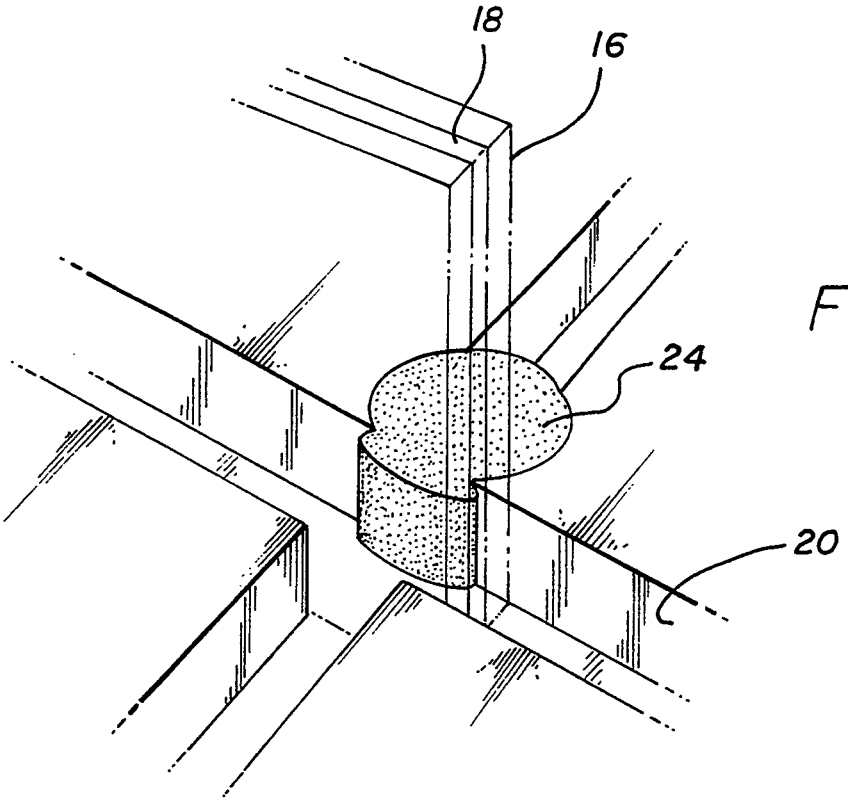
FIG. 3A

DISPLAY DEVICE FOR PHOTOGRAPHS AND PRINTED IMAGES

BACKGROUND OF THE INVENTION

The present invention is related to image display devices and more particularly to a device for both storing and displaying one or more photographs or printed images.

Conventional devices for displaying printed images typically hold one or more images, such as photographs, which are displayed by hanging the device on a vertical surface or setting the device upright on a horizontal surface. In order to change the photographs being displayed, the display device is disassembled and the photograph is removed from the device and the new photograph inserted in its place. Additionally, conventional display devices usually have no provision for storing photographs which are not currently being displayed.

Thus, there is a need for a display device for displaying printed images which can display and/or store one or more images and in which the images being displayed can be quickly and easily changed.

SUMMARY OF THE INVENTION

The present invention provides a display device for photographs and printed images. The display device has a one or more display plates for displaying one or more printed images, and a container for storing additional printed images that are not currently being displayed. More particularly, each printed image to be displayed is placed within one of the display plates which are then inserted into display slots located in the top of the display box. The printed images not currently being displayed are placed inside the container for storage. When the printed image being displayed is to be changed, the printed image is removed from the display plate and placed in the container for storage. Likewise, a replacement image to be displayed is removed from the container and placed in one of the display plates which is then inserted into a display slot.

Additionally, all of the printed images may be placed in the container for transporting, thus assuring that the printed images are not lost or damaged during transit.

BRIEF DESCRIPTION OF THE DRAWINGS

FIG. 3 is a perspective view of the photograph display device of FIG. 1 illustrating a typical resilient retainer for providing additional force to retain a display plate.

DETAILED DESCRIPTION OF THE PREFERRED EMBODIMENT

Figure 1:
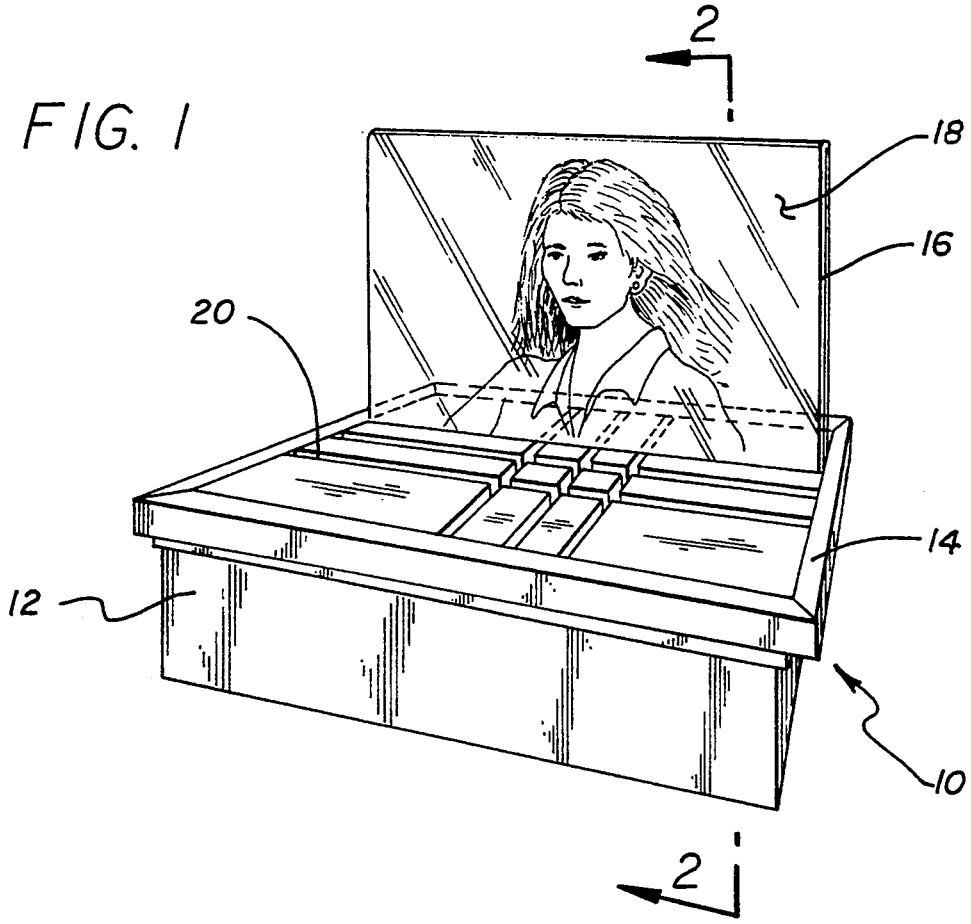
FIG. 1 is a perspective view of a photograph display device constructed in accordance with the present invention.

In FIG. 1, a perspective view of a printed image display device 10 constructed in accordance with the present invention is shown. In the following description, the term "photograph" will be used to refer to any of the printed images which may be displayed using the present invention. However, such use is not intended to limit the invention to only camera-acquired photographs.

As shown in FIG. 1, display device 10 is generally rectangular in shape, and includes a container 12 and a top 14 having one or more display slots 20. Container 12 and top 14 may be constructed of wood, plastic or other suitable material. Additionally, top 14 may be completely removable from container 12, or may be hinged at one end to allow it to tilt to open and close.

Continuing with FIG. 1, a rectangular display plate 16 is included for holding and displaying a photograph 18. Display plate 16 is preferably made a rectangular sheet of plexiglas or other plastic material which is sufficiently rigid to support photograph 18. Display plate 16 is formed by folding the plexiglas sheet in half so that one of the surfaces forms a close-fitting crevice for holding photograph 18. The other surface of the plexiglas sheet forms the front and back faces of display plate 16. Once formed, photograph 18 is mounted to display plate 16 by insertion into the close-fitting crevice. Display plate 16 is then inserted into one of display slots 20 in top 14. Display plate 16 containing photograph 18 is thus held snugly in place.

Figure 2:
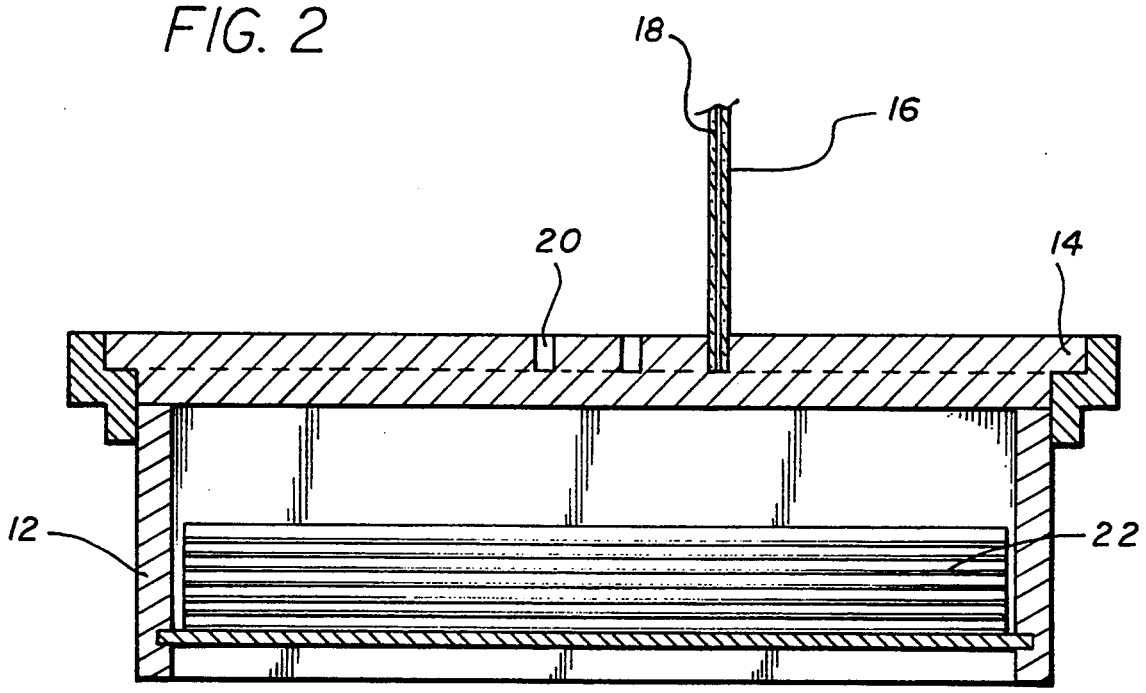
FIG. 2 is a sectional view of the photograph display device of FIG. 1 illustrating both its storage and display capabilities.

Referring to FIG. 2, in one embodiment each of the one or more display slots 20 of top 14 may be oriented perpendicular to the surface of top 14. Display slots 20 may also be oriented perpendicular to the edges of top 14 and are perpendicular to each other. In another embodiment, display slots 20 may be angled relative to the surface of top 14 and may also be angled with respect to each other. In either embodiment, display slots 20 may contain at least one resilient retainer 24 (FIG. 3) for providing additional force to retain display plate 16.

In still another embodiment, a display slot may be formed using parallel ridges or other protrusions which are attached to top 14.

Continuing with FIG. 2, one or more additional photographs 22 may be stored in container 12 when they are not being displayed. Additional photographs 22 may be arranged either horizontally (FIG. 2) or vertically and, if arranged vertically, vertical dividers may be included to separate and/or categorize the stored photographs. Note also that by providing multiple display slots in top 14 of the display device 10, more than one photograph may be simultaneously displayed.

Thus, the present invention provides a display device for printed images in which the printed image being displayed may be quickly changed. The display device of the present invention also provides for the storage of one or more additional printed images which are not currently being displayed. The storage provision allows the printed images to be transported without being damaged.

While a preferred embodiment of the present invention has been described, it should be noted that a number of changes and improvements can be made to the present invention without departing from the spirit and scope of the invention. Accordingly, the invention is not to be limited by the specific illustrated embodiment but only by the scope of the appended claims.

What is claimed is:

1. A photograph display device for displaying photographs, comprising:

a display plate providing support for at least one photograph, said display plate constructed by folding a single sheet of plexiglass to form a crevice for holding said photograph;

container means including a top for storing and displaying said at least one display plate, said top attachable to said container, wherein said top includes at least one display slot having vertical walls for holding said at least one of said display plate in an upright vertical position; and a resilient retainer for providing force to retain said at least one display plate in said at least one display slot, wherein said resilient retainer is at least partially mounted in one of a second set of at least one intersecting slots formed at generally right angles to the at least one display slot.

2. The photograph display device of claim 1 wherein said container means is made of wood.

3. The photograph display device of claim 1 wherein said container means is made of plastic.

* * * * *